United States Patent [19]

Matsuda et al.

[11] 4,172,411

[45] Oct. 30, 1979

[54] HYDRAULIC HAMMER

[75] Inventors: Makoto Matsuda, Sumida; Takeo Watanabe, Yokohama, both of Japan

[73] Assignee: Mitsui Engineering & Shipbuilding Co., Ltd., Tokyo, Japan

[21] Appl. No.: 803,989

[22] Filed: Jun. 6, 1977

[30] Foreign Application Priority Data

Jun. 9, 1976 [JP] Japan ..... 51-67958
Jun. 9, 1976 [JP] Japan ..... 51-75633[U]

[51] Int. Cl.[2] ..... F01L 25/06

[52] U.S. Cl. ..... 91/278; 91/300; 91/307

[58] Field of Search ..... 91/307, 300, 278

[56] References Cited

U.S. PATENT DOCUMENTS

| | | | |
|---|---|---|---|
| 295,003 | 3/1884 | Holsey | 91/300 |
| 806,128 | 12/1905 | Flottmann | 91/300 |
| 870,391 | 11/1907 | Starrett | 91/307 |
| 3,361,036 | 1/1968 | Harvey et al. | 91/224 |
| 3,713,365 | 1/1973 | Goodrich | 91/25 |
| 3,780,621 | 12/1973 | Romell | 91/278 |

*Primary Examiner*—Paul E. Maslousky
*Attorney, Agent, or Firm*—Koda and Androlia

[57] ABSTRACT

A hydraulic hammer wherein the reciprocal motion of a drill-striking piston is operated by means of a spool valve for switching hydraulic pressure to a double-acting cylinder depending upon the position of the piston. The hydraulic hammer further includes a self starter means which assures activation of the hammer whenever hydraulic pressure is applied to the hydraulic hammer and a means for compensating for variations in boring conditions such that energy is efficiently delivered by the drill striking piston.

2 Claims, 8 Drawing Figures

HYDRAULIC HAMMER

BACKGROUND OF THE INVENTION

1. Field of the Invention

This invention relates to hydraulic hammer and more particularly to self-starting hydraulic hammer.

2. Prior Art

In a typical prior art self-starting hydraulic hammer, the piston and spool, whose valve acts as a switching means for the piston, are each in unspecified free positions during inactive periods. Therefore, application of hydraulic pressure to the hydraulic hammer may not always activate the piston if the piston and spool are not in the proper positional relationship.

In addition, in order to maintain a stable reciprocating motion of the piston, the size and shape of the piston and cylinder used in prior art self-starting hydraulic hammers are limited considerably to very tight tolerances. These tight tolerances limits the freedom of design as well as the capability of the hydraulic hammer. Moreover, since the number of strokes and the speed of the piston is necessiarly determined by the weight of the piston and the applied hydraulic pressure, it is difficult for a proper combination of the number of strokes and energy as a result of various rock conditions, boring diameters, etc. A further disadvantage of the prior art self-starting hydraulic hammers is that the pressing time (the duration during which the piston presses against the boring tool) is too short to deliver an efficient transfer of energy to the rock.

SUMMARY OF THE INVENTION

Accordingly, it is a general object of the present invention to provide a self-starting hydraulic hammer which is activated whenever hydraulic pressure is applied to the hydraulic hammer. It is another object of the present invention to provide a self-starting hydraulic hammer capable of compensating for variations in boring conditions.

It is still another object of the present invention to provide a self-starting hydraulic hammer which efficiently delivers energy via the drill-striking piston.

In keeping with the present invention, the objects are accomplished by a unique hydraulic hammer wherein reciprocal motion of a drill-striking piston is controlled by means of a spool valve switching the hydraulic pressure to a double acting cylinder which depends upon the position of the piston. The hydraulic hammer further includes a self-starter means which assures activation of the piston whenever hydraulic pressure is applied to the hydraulic hammer and a means for compensating for variations in boring conditions such that energy is efficiently delivered by the drill-striking piston.

BRIEF DESCRIPTION OF THE DRAWINGS

The above mentioned features and objects of the present invention will become more apparent with reference to the following description taken in conjunction with the accompanying drawings, wherein like reference numerals denote like elements, in which.

DETAILED DESCRIPTION OF THE INVENTION

Figure 1:
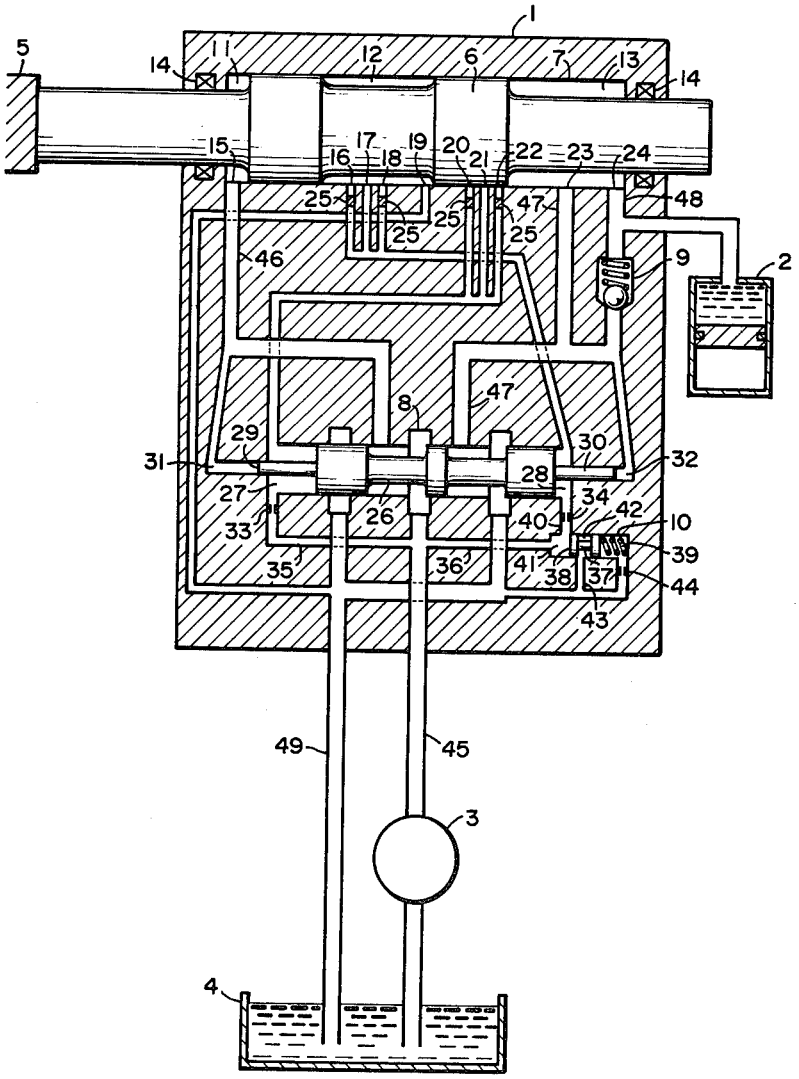
FIG. 1 is a cross-sectional view of an embodiment of a hydraulic hammer in accordance with the teachings of the present invention in which the piston is about to begin its return cycle.

Referring more particularly to the drawings, shown in FIG. 1 is an embodiment of a hammer in accordance with the teachings of the present invention. The hammer includes a hammer body 1, an accumulator 2, a pump 3 and a tank 4. The hammer strikes a boring tool 5.

The body 1 of the hammer comprises a double acting cylinder 7 with a piston 6 for striking the boring tool 5. The body 1 further includes a spool valve 8, a reverse valve 9, a starter device 10 and passage ways interconnecting the spool valve 8, reverse valve 9 and starter device 10.

The cylinder 7 is divided into a forward chamber 11, central chamber 12 and a rear chamber 13 by the piston 6. Piston 6 is supported by a bearing 14 which provides an air seal. Ports 15 through 24 are disposed about the cylinder 7 for relief of pressure. Port 15 is disposed at the end closest to the boring tool, port 24 is disposed closest to the end which is opposite from the end closest to the boring tool 5 and port 23 is disposed closer to the center of the cylinder than port 24 and such that it connects with rear chamber 13 within the cylinder 7. The group of ports 16, 17 and 18 and the groups of ports 20, 21 and 22 are disposed slightly off center of the cylinder 7 so that they alternately connect with the cylinder's central chamber 12 depending upon the position of the pistions 6. Port 19 is disposed at a postion where it is always connected to the cylinder central chamber 12 regardless of the position of the piston 6. A stopper 25 is provided in each of the ports 16 and 18 and 20 and 22 such that the desired ports may be opened while the others are shut. In FIG. 1, ports 17 and 21 are shown in their open state.

Spool valve 8 is of a two position, four port types. A spool 26 with three land members is slideably contained in the spool valve 8. Ordinary pilot pressure chambers 27 and 28 are disposed on either side of the spool 26. In addition, plunger chambers 31 and 32 are disposed on either side of the spool through plungers 29 and 30 respectively. These pilot pressure chambers 27 and 28 are connected to ports 20, 21, 22 or 16, 17 and 18 respectively. Chambers 27 and 28 are also connected to throttles 33 and 34 and pilot passage ways 35 and 36 respectively to pump 3. Plunger chambers 31 and 32 are coupled respectively to cylinder forward chamber 11 and rear chamber 13. Thus, in addition to the ordinary pilot pressure, pressures in the cylinder forward and rear chambers also act upon spool 26 as pilot pressure.

The starter device 10 is provided in the pilot passage 36 in the spool valve 8. The starter device 10 includes a plunger gate with a dent 37 in its center, spring 39 and a plunger chamber 40 containing the plunger 38 and spring 39. A pressure chamber 41 is disposed in the plunger chmaber 40 on the side closest to the spool valve 8 and is coupled via pilot passage 36 to tank 4. Central pressure chamber 42 is coupled via pilot passage 43 to tank 4. The pressure chamber farest from the spool valve 8 is coupled via a throttle 44 to tank 4.

The main passage connecting the components is laid out such that liquid which is pumped up from tank 4 by pump 3 is routed through the spool valve 8 where the high pressure liquid is alternately supplied or unloaded to the cylinder 4 chamber 11 and cylinder rear chamber 13. More specifically, duct 45 couples pump 3 and spool valve 8 together, duct 46 couples a port on one side of the spool valve 8 to port 15 in the cylinder 7 and duct 47 couples the port on the other side of the spool valve 8 to the port 23 in the cylinder 7. In addition, a passage way branches out from duct 49 and connects to port 45 in cylinder 7. Furthermore, port 24 is coupled to duct 47 via a reverse valve 9 in duct 48. An accumulator 2 is coupled to duct 48. The reverse valve 9 is provided so as to prevent high pressure liquid from flowing back from the cylinder 7 to the spool valve 8. The other port in the spool valve 8 is unloaded by duct 49.

In operation, as shown in FIG. 1, the piston 6 has struck the boring tool 5 and is about to begin its return cycle. At this point, the port 17 is open so that part of the high pressure liquid from the pump 3 is unloaded through throttle 34, pilot pressure chamber 28, cylinder central chamber 12 and port 19. This flow causes a pressure gradient to develop on either side of the throttle 34 such that the pressure in the pilot chamber 28 decreases. On the other hand, the pressure in the opposite pilot pressure chamber 27 is equal to the supply pressure because the port 21 is shut by the land member of the piston 6. Thus, the spool 26 is pushed to the right in the drawings.

As a cylinder forward chamber 11 is pressurized by the high pressure liquid from pump 3, the cylinder rear chamber 13 is unloaded until just a residual back pressure remains and piston 6 commences to move to the right. At this point, the respective pressure levels in both of the plunger chambers 31 and 32 are equal to the pressure levels in the cylinder forward chamber 11 and rear chamber 13. Because this pressure level is maintained until the piston 6 completes its return cycle, port 17 and 21 are simultaneously shut or open during the piston's 6 return cycle such that the position of the spool 26 remains stationary even if the pressure in the pilot chambers 27 and 28 should become equalized.

Figure 2:
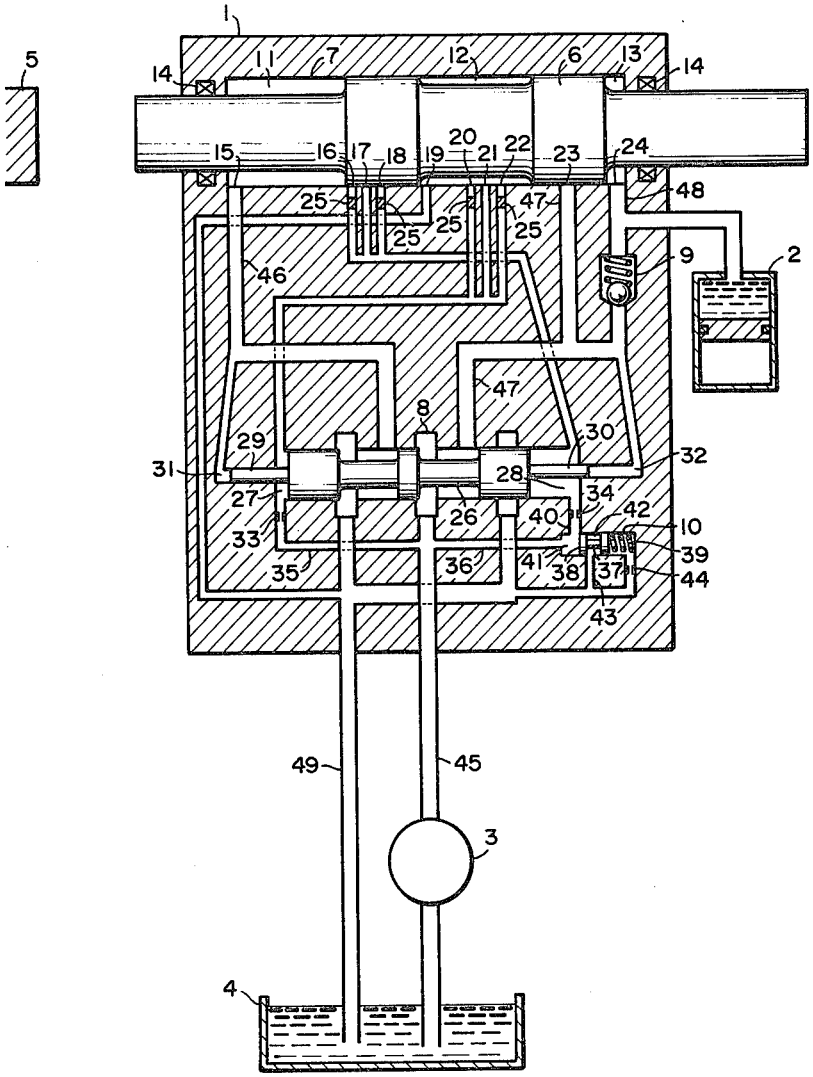
FIG. 2 illustrates a cross-sectional view of the embodiment of FIG. 1 in which the piston is about to begin its strike cycle.

As the piston 6 completes it return cycle and the port 21 opens, part of the high pressure liquid from the pump 3 is unloaded through throttle 33, pilot pressure chamber 27, cylinder central chamber 12 and port 19 thereby lowering the pressure in the pilot chamber 27. Meanwhile, the pressure in the opposite pilot chamber 28 is equalized with the supply pressure as the port 17 is shut off by the land member of the piston 6. Whereupon, the spool 26 moves to the left to commence the strike cycle (as shown in FIG. 2). At this point, plunger member 29 is pressurized, as previously described, and the force works to prevent the movement of spool 26. However, in order to enable the spool 26 to move, this force is overcome by selecting a proper ratio of the respective pressure receiving areas of the spool 26 and the plunger 29.

Because of inertial force, the piston 6 continues to retreat even after the spool valve 8 has been switch to the strike cycle position. As the piston 6 retreats further and as port 23 is shut, the liquid in the rear chamber 13 is discharged from port 24 and enters into accumulator 2 and is prevented from flowing into the spool valve 8 by valve 9. The accumulator 2 causes the piston 6 to brake whereupon the piston 6 enters into the strike cycle.

At the beginning of the strike cycle, the port 23 and the reverse valve 9 are both shut so that the high pressure liquid accumulated in accumulator 2 accelerates the piston's 6 speed. As piston 6 moves forward, the pressure in the cylinder rear chamber 13 is lowered below the level of the supply pressure and reverse valve 9 opens to allow the high pressure liquid from pump 3 to accelerate the piston 6. Further progress of the piston 6 opens port 23 and high pressure liquid enters the rear chamber 13 through duct 47 which is unobstructed by a reverse valve or the like. The piston 6 accelerated further by this pressure moves to the left and strikes the boring tool 5.

As previously described, the port 17 opens just before the piston strikes the boring tool 5 thus lowering the pressure in the pilot pressure chamber 28. This causes the spool 26 to switch to a position as shown in FIG. 1. Thereby repeating the above described procedure and piston retreats and then striking the boring tool in succession.

In the presently preferred embodiment of the hammer, the starter device 10 is provided to ensure the activation of piston 6. The piston 6 and the spool 26 in the hammer or the present invention are each in an unspecified position during inactive periods. When they are at dead points, application of high pressure liquid equalizes the pressure in pilot pressure chambers 27 and 28 such that the piston may not always activate. In order to overcome this deficiency, during inactive periods the spring 39 in the starter device 10 pushes the plunger 38 to the left to close the duct 36 as well as to unload the pilot pressure chamber 28. Therefore, immediately after activation, pressure in the pilot chamber 27 is higher than the pressure in the chamber 28 and the spool moves reliably to the right. Thus, dead points are eliminated and activation is assured.

Following activation, the supply pressure being stronger than the force of the springs 39 forces the plunger 38 to the right so as to open the duct 36 thereby enabling the piston 6 to move without obstruction.

In the above described embodiment, the ports 16, 17 and 18 are provided at three arbitrary locations in intervals along the direction of the piston 6 movement. Moreover, the ports are designed such that they open to the cylindrical central chamber 12 just before the piston 6 strike boring tool 5. Thus, in order to adjust the pressing time, it is possible to vary the timing of switching spool 26 by placing the stopper 25 in the desired port. If a variation in the stroke of the piston is desired, selection of the ports 20, 21, 22 will similarly change the timing of the switching of the spool 26.

Alternation in the timing of the switching of the spool valve 8 can also be accomplished by changing the diameter of the throttles 33 and 34. Specifically, the change in the diameter of the two throttles 33 and 34 changes the decreasing amount of pressure in the pilot chamber 27 and 28 which in turn change the force applied to spool 26 thereby altering the responsiveness of the spool valve 8. Accordingly, this brings about similar results, as described, with respect to changes in switch timing by means of a changing in the port locations.

Accordingly, by changing the placement of stoppers 25 in ports 16 through 18 and 20 through 21 or by changing the diameters of throttles 33 and 34, it is possible to compensate for variation in boring conditions.

In particular, in FIG. 1, if the diameters of throttles 33 and 34 are lessened, then, the pressure of the pilot pressure chambers 27 and 28 is lowered thereby decreasing the force to move the spool to the right, with the result that the ports 17 and 21 are switched over, thus extending the period from the entry of a signal to the completion of movement to the right. Therefore, the piston 6 abuts against the tool 5 at the same speed as that prior to the change in the throttles, thus extending the duration prior to the start of returning movement. The opposite result occurs if the diameters of the throttles 33 and 34 are increased, thereby decreasing the duration prior to the start of return cycle.

Figure 3:
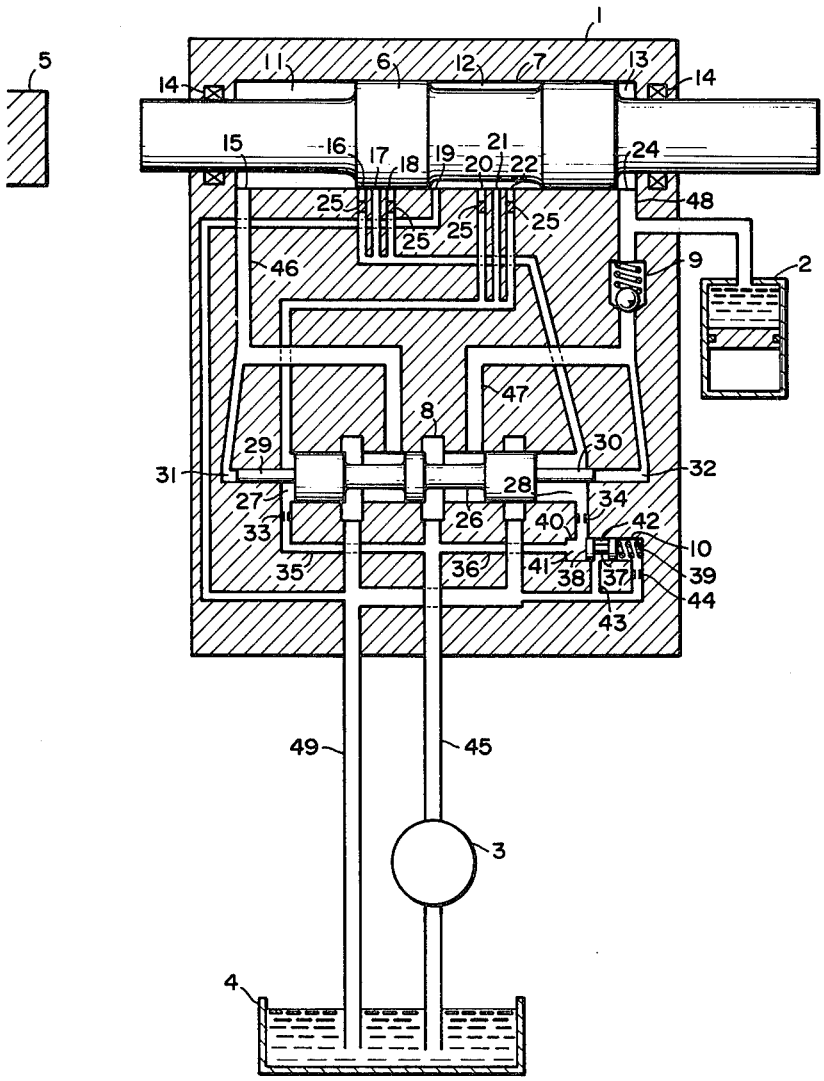
FIG. 3 illustrates a cross-sectional view of a second embodiment of a hydraulic hammer in accordance with the teachings of the present invention.

Referring to FIG. 3, shown therein is a second embodiment of a control mechanism in accordance with the teachings of the present invention as adapted to a hammer with a differential cylinder, that is one in which the front and rear affective pressure receiving areas of the piston are different. A hammer of this type is different from the previously described emobidment in that the diameter of the piston on the side facing the boring tool is smaller than that on the other side and also port 23 in the cylinder rear chamber 13 is not provided.

In operation, in the hammer FIG. 3 after the piston strikes the boring tool 5, high pressure liquid enters the cylinder forward chamber 11 by means of the spool valve 8 as previously described. As piston 6 moves to the right all the liquid in the cylinder rear chamber 13 is accumulated in the accumulator 2. The pressure in the cylinder rear chamber 13 may exceed the supply pressure at this point, but the difference in the pressure receiving areas of the piston makes it possible for the piston to return without hinderence. As the spool valve 8 switches, the cylinder forward chamber 11 connects with tank 4 causing the pressure in the chamber 11 to drop whereupon the piston 6 goes into the strike cycle. The recriporcal motion of the piston 6 continues by repeating the above procedure.

Figure 4:
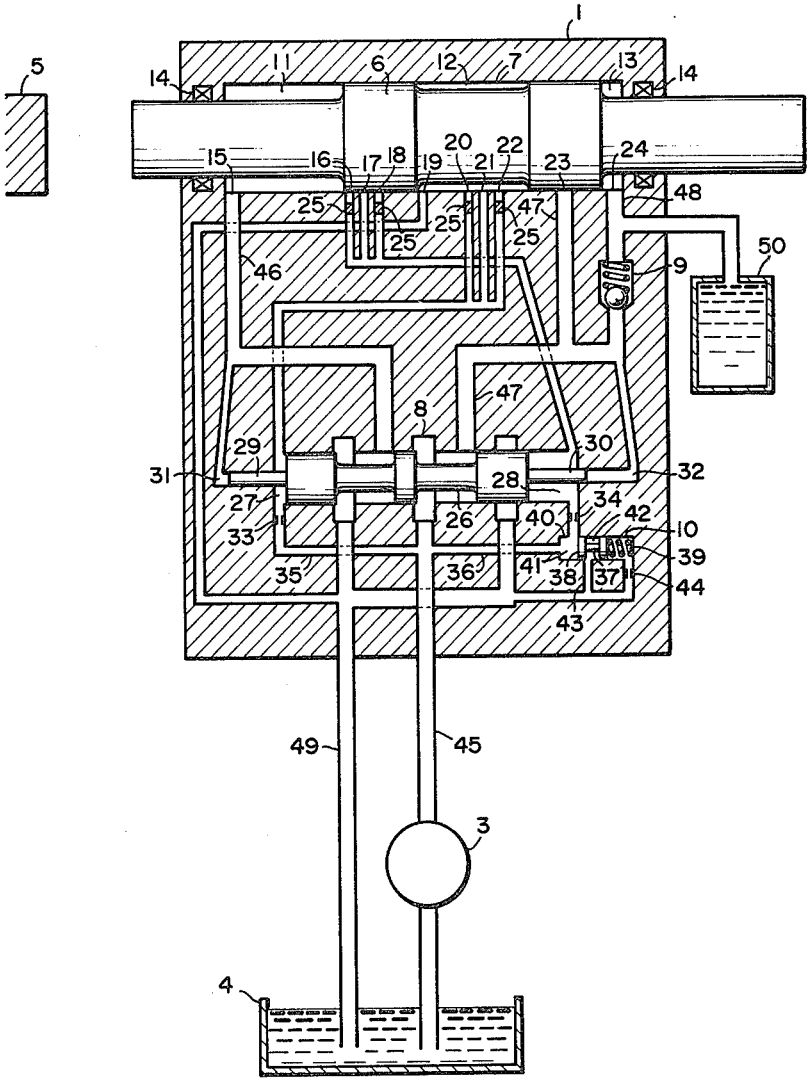
FIG. 4 illustrates a cross-sectional view of a third embodiment of a hydraulic hammer in accordance with the teachings of the present invention.

Referring to FIG. 4, shown therein is a third embodiment of a hammer in accordance with the teachings of the present invention. In the embodiment of FIG. 4, the accumulator 2 is replaced by a fluid chamber 50. The fluid chamber 50 of the present invention overcomes the problems associated with the ordinary bladder or diaphram type accumulators whose response capability and durability are not compatible with the high number of strokes required from the hammer. In all ways the operation of this third embodiment is substantially the same as that described in FIG. 1.

Figure 5:
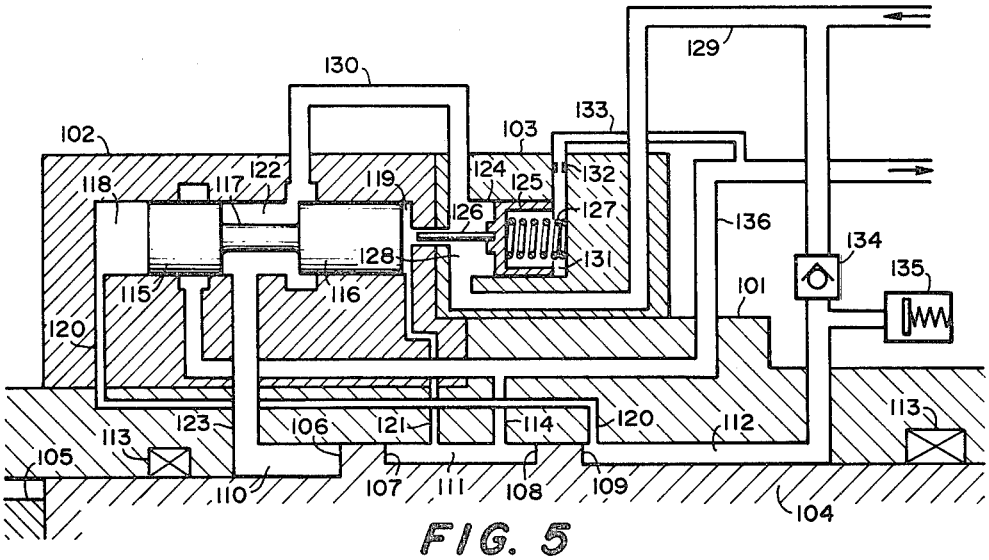
FIG. 5 is a cross-sectional view of a fourth embodiment of a hydraulic hammer in accordance with the teachings of the present invention showing a piston about to begin its return cycle.

Referring to FIG. 5, shown therein is a cross-sectional view of a fourth embodiment of a hydraulic hammer in accordance with the teachings of the present invention. The hammer includes a differential cylinder 101, a spool valve 102 and a starting device 103. A piston 104 is slideably contained within the differential cylinder 101 such that one end of the piston strikes a boring tool 5 such as for example a shank rod. The piston 104 has four ledges 106, 107, 108 and 109. Each of the ledges 106, 107, 108 and 109 form in conjunction with the wall of the piston 104 a pressure chamber 110 on the side closest to the boring tool 105 (hereinafter referred to as the cylinder forward chamber 110), a cylinder central chamber 111 and a pressure chamber 112 on the side farest from the boring tool 105 (hereinafter referred to as the cylinder rear chamber 112). The cylinder 101 is maintained air type by a piston bearing 113 with pressurizing capabilities. The pressure in the cylinder central chamber 111 is unloaded at all times by a duct 114.

The two position, three port type spool valve 102 contains a spool 117 slideably disposed therein. The spool 117 has two land members 115 and 116. Pilot chambers 118 and 119, disposed in the spool valve 102 are respectively connected via ducts 120 and 121 to cylinder rear chamber 112 and cylinder central chamber 111 (when the spool is in the position shown in FIG. 6). The central chamber 122 in the spool valve 102 is connected through duct 123 to the cylinder forward chamber 110.

The start device 103 is provided with a spring loaded cylinder 124 within the body of the hammer and a plunger 125 with a rod slideably disposed within the cylinder 124. The rod 126 is disposed through a small hole 126 provided on the spool valve 102 so as to press against the spool 117. Springs 127 are provided on the other side of plunger 125. A pressure chamber 128, provided on the spool side of plunger 125 is connected via duct 129 to a hydraulic source on one hand and by a duct 130 to the central chamber 122 of the spool valve 102 on the other hand. A pressure chamber 131 on the opposite side of the plunger is unloaded through a throttle 132 and duct 133. A reverse valve 134 and accumulator 135 are provided in the hammer for the purposes of maintaining a high level of pressure in the rear chamber 112.

Figure 6:
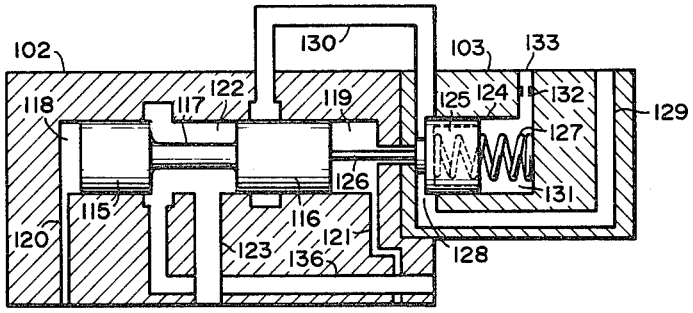
FIG. 6 is a cross-sectional view of the embodiment of FIG. 5 showing the hammer in a motionless state.

In operation, when the hammer is inactive, there is no supply of high pressure from the hydraulic source. In this state, the plunger 125 is pushed to the left by the spring 127 as shown in FIG. 6.

As high pressure is supplied from the hydraulic source to start the hammer, the pressure is also applied through duct 129 to the pressure chamber 128 of the plunger. By the action of the throttle 132, the plunger 125 compresses the spring 127 and the plunger 125 gradually moves to the right. In the meantime, pressure in the cylinder forward chamber 110 is being unloaded through ducts 123 and 136 while the cylinder rear chamber 112 is being loaded with high pressure liquid such that the piston 104 is caused to move to the left, regardless of its current position, and the piston 104 enters upons its strike cycle.

As the piston 104 moves to the left, the pilot chamber 118 in the spool valve 102 is coupled to the cylinder rear chamber 112 while the pressure in the pilot chamber 119 at the opposite side is unloaded through duct 121, cylinder central chamber 111 and ducts 114 and 136 such that spool 117 is pushed to the right as shown in FIG. 5. In this state, high pressure liquid is acting upon the cylinder forward chamber 110 and the cylinder rear chamber 112. However, because the pressure receiving area of the piston on the side of the forward chamber 110 is larger than that on the side of the rear chamber 112, the piston 104 is pushed to the right for its return cycle.

As the piston 104 moves further to the right, (reaching the position shown in FIG. 7) duct 121 connects with the cylinder forward chamber 110 and duct 120 connects with cylinder central chamber 111 causing the pilot chamber 119 and the spool valve 102 to become pressurized whereupon the spool 117 is caused to move to the left. At this point, pressure in the cylinder forward chamber 110 is unloaded through spool valve central chamber 122 and duct 136 and the piston 104 is pushed to the left to begin its strike cycle.

Figure 7:
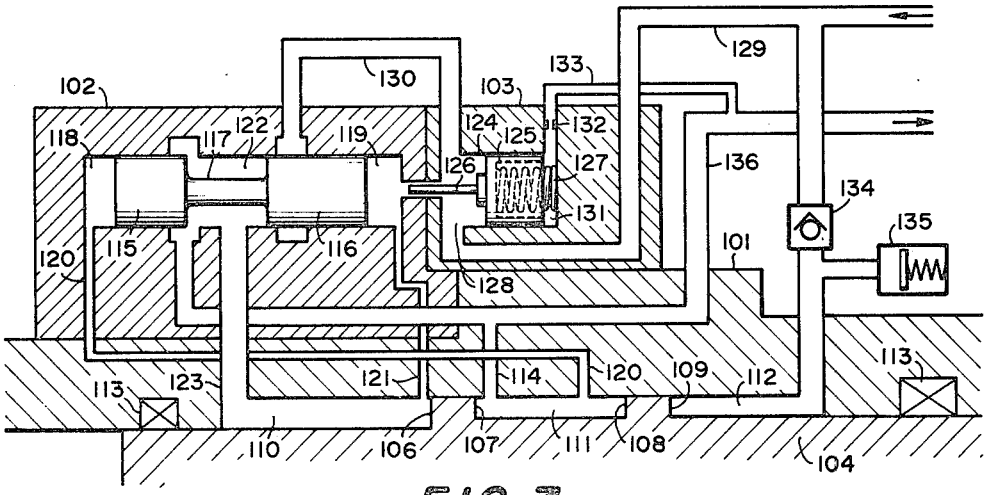
FIG. 7 is a cross-sectional view of the embodiment of FIG. 5 showing the piston about to begin its strike cycle.

The piston strikes the boring tool 105 in succession by repeating the above procedure. Because the force of the applied pressure is greater than that of the springs 127, the plunger 125 is always pushed to the right after the hammer has been activated, as shown in FIGS. 5 and 7. The rod 126, therefore, is held so as not to interfere with the movement of spool 117.

Figure 8:
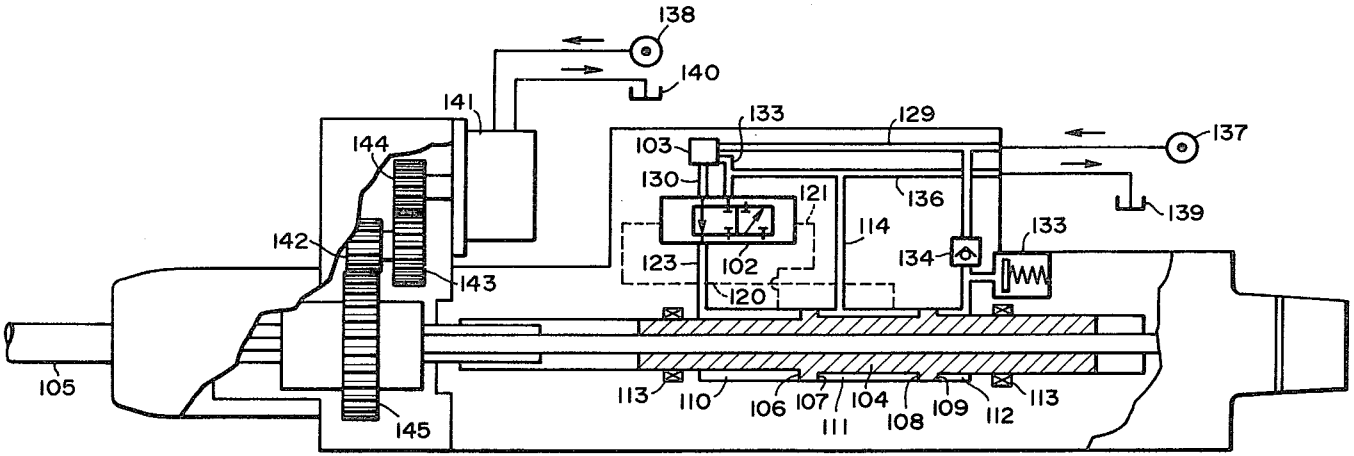
FIG. 8 is a partial cross sectional view of rotary hammer drill employing the hammer of the present invention.

Referring to FIG. 8, shown therein is a rotary hammer drill utilizing a hydraulic hammer in accordance with the teachings of the present invention. In FIG. 8, the hydraulic hammer is provided with a hydraulic source 137 and a tank 139. The rotary hammer drill comprises a hydraulic motor 141 driven by hydraulic source 138 and a tank 140. The hydraulic motor 141 drives rotary gears 142, 143 and 144 which in turn drive a tooth rotary sleeve 145.

From the above description, it is apparent that the hydraulic hammer of the present invention does not require complicated measures to hold it in a delicate balance as is the case in prior art hammers. Accordingly, the hammer of the present invention can be easily designed and manufactured and the number of strokes and the duration of the pressing time can be varied to cope with various boring conditions. In addition, because of the starter device, the hammer is always activated upon the application of pressurized hydraulic liquid no matter what position the piston and spool are in.

In all cases it is understood that the above described embodiments merely illustrative of but a few of the many possible specific embodiments which represent the applications of the principles of the present invention. Numerous and varied other arrangements can be readily devised by those skilled in the art without departing from the spirit and scope of the invention.

I claim:

1. A hydraulic hammer of the type wherein reciprocal motion of a piston is controlled by a spool valve which switches hydraulic pressure to a double-acting cylinder according to the position of said piston, said hammer being characterized by:

a spool having a first and second pilot pressure chamber provided respectively at each end thereof, said first pilot pressure chamber being coupled to a hydraulic source via a first passageway having a first throttle provided therein and to a plurality of first ports capable of being connected to a central chamber of said double acting cylinder along an axis of said double acting cylinder via a second passageway, said first ports opening and closing in response to the position of said piston, said second pilot chamber being coupled to said hydraulic source via a third passageway having a second throttle and to a plurality of second ports capable of being connected to said central chamber of said double acting cylinder along an axis of said double acting cylinder via a fourth passageway, said second ports opening and closing alternately with said first ports in response to the position of said piston, said first and second ports being arranged and configured to be selectively operational;

first and second plungers; and first and second plungers chambers having respectively slidably disposed therein said first and second plungers, said first plunger chamber being coupled to a forward chamber of said double acting cylinder and said second chamber being coupled to a rear chamber of said double acting cylinder.

2. A hydraulic hammer according to claim 1 further comprising a spring loaded plunger disposed in a third plunger chamber in said first passage between said hydraulic source and said first throttle, a third port provided at one end of said third chamber which is coupled to said hydraulic source, and a central chamber of said spring loaded plunger being coupled to a hydraulic tank.

* * * * *